United States Patent [19]

Boan et al.

[11] Patent Number: 4,609,923

[45] Date of Patent: Sep. 2, 1986

[54] GOLD-PLATED TUNGSTEN KNIT RF REFLECTIVE SURFACE

[75] Inventors: Bobby J. Boan, Indian Harbour Beach; Martin Schwam, Indialantic; Marvin R. Sullivan; Amos W. Morse, both of Palm Bay, all of Fla.

[73] Assignee: Harris Corporation, Melbourne, Fla.

[21] Appl. No.: 530,631

[22] Filed: Sep. 9, 1983

[51] Int. Cl.[4] ..... H01Q 1/36

[52] U.S. Cl. ..... 343/897; 343/912; 66/202

[58] Field of Search ..... 343/909, 840, 915, 897, 343/18 R, 18 B, 912; 245/1-11; 428/256, 379, 380; 361/411; 57/200, 210, 232, 258; 66/169 R, 169 A, 170, 198, 202; 87/3, 12, 13; 139/425 R

[56] References Cited

U.S. PATENT DOCUMENTS

| | | | |
|---|---|---|---|
| 3,327,866 | 6/1967 | Pall et al. | 428/256 |
| 3,855,598 | 12/1974 | Keller | 343/915 |
| 3,864,179 | 2/1975 | Davidoff | 361/411 |
| 4,191,604 | 3/1980 | MacTurk | 343/897 |
| 4,353,070 | 10/1982 | Pyee | 343/701 |
| 4,439,768 | 3/1984 | Ebneth et al. | 343/909 |
| 4,549,187 | 10/1985 | Levy | 343/897 |

OTHER PUBLICATIONS

*Knitting Times*, "Metex, New Knitted Metal Textile, Introduced", vol. 40, No. 28, Jul. 5, 1971, pp. 24–25.

*Primary Examiner*—Eli Lieberman
*Assistant Examiner*—Michael C. Wimer
*Attorney, Agent, or Firm*—Antonelli, Terry & Wands

[57] ABSTRACT

An improved antenna mesh material is made of gold-plated tungsten wire. Because gold-plated tungsten can be drawn to a very fine diameter (less than one mil) it results in a knit mesh having low mechanical stiffness. It also has high electrical conductivity, thereby enhancing its operation as an antenna reflector up to the higher RF frequencies (EHF). In addition, gold-plated tungsten has both sufficient tensile strength and a low coefficient of thermal expansion which enables it to maintain high reflector surface accuracy for changing thermal conditions.

13 Claims, 3 Drawing Figures

GOLD-PLATED TUNGSTEN KNIT RF REFLECTIVE SURFACE

FIELD OF THE INVENTION

The present invention relates in general to electrically conductive mesh articles and, especially, to those characterized for use as flexible high performance reflective antenna surfaces.

BACKGROUND OF THE INVENTION

Continuously expanding efforts in current-day communication technology, including satellite-based systems, require high performance signal transmission structures, such as mesh antennas, that may be deployable or non-deployable. Knit mesh materials have been used on high performance reflector designs and their continued use as reflector materials can be expected in the future. Unfortunately, mesh antenna structures suffer from a significant problem of high in-plane mechanical stiffness, which can manifest itself through a number of characteristics including difficulty in maintaining surface contour manufacturing tolerances, difficulty in maintaining tension in the surface resulting from thermoelastic effects, and distortion of structural members also resulting from theremoelastic effects of the mesh. Each of these effects can degrade antenna performance.

Current trends toward larger apertures and higher RF operational frequencies make stiffness a very significant parameter in antenna design. In addition, as the operating frequency increases, the mesh hole size must decrease in order to maintain RF performance. As mesh stiffness is inversely proportional to hole size, the technical challenge is to develop a mesh which satisfies both low stiffness and high RF reflectivity requirements.

SUMMARY OF THE INVENTION

In accordance with the present invention the above requirements are satisfied by the use of an improved antenna mesh material made of gold-plated tungsten wire which enjoys a number of properties that make it especially suitable for a high performance RF antenna. Because gold-plated tungsten can be drawn to a very fine diameter (less than one mil) it can be used in a knit mesh having low mechancial stiffness. It also has high electrical conductivity, thereby enhancing its operation as an antenna reflector up to the higher RF frequencies (EHF). In addition, gold-plated tungsten has both sufficient tensile strength to knit at 0.5 mils diameter and a low coefficient of thermal expansion ($2.2\times10^{-6}$ in/in.-°F.) which enables it to maintain high reflector surface accuracy for changing thermal conditions. This combination of very favorable electrical and mechanical properties makes such a mesh knit made from fine diameter tungsten wire applicable to the design and fabrication of light-weight, RF-efficient reflective surfaces.

DETAILED DESCRIPTION

Figure 1:
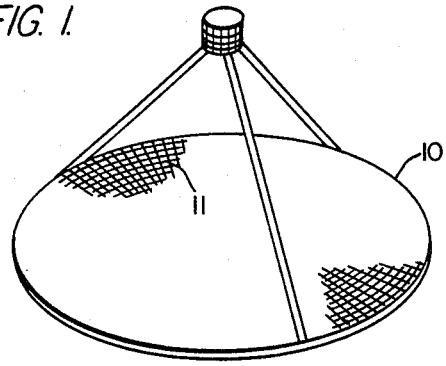
FIG. 1 is a perspective view of a mesh radio wave reflector.
Figure 2:
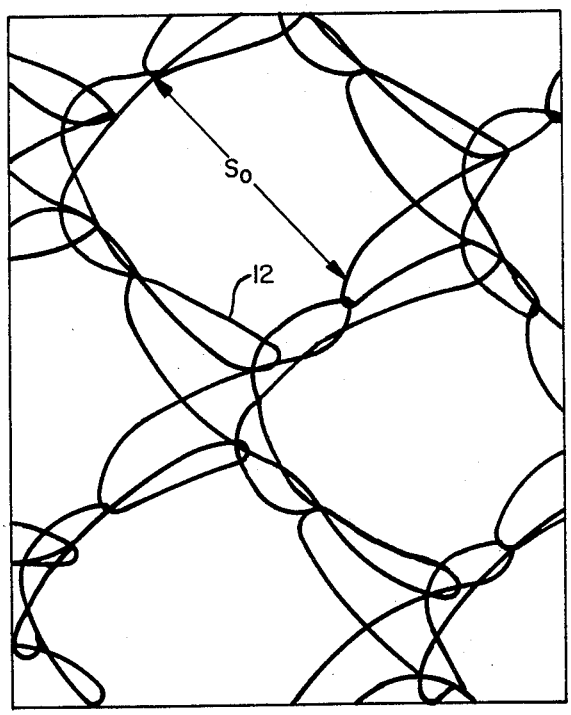
FIG. 2 is an enlarged detailed view of a mesh weave in which the gold-plated tungsten filament material may be incorporated.

A typical antenna structure in which the improved knit mesh material of the present invention may be incorporated is shown in FIG. 1 as a paraboloid mesh 10 comprised of a network of fibers 11 having a spacing predetermined by the frequency of the RF energy to be reflected. Advantageously, the mesh knit is a tricot type mesh configuration, shown in detail in FIG. 2. FIG. 2 illustrates a 20 gauge knit having a hole count of 28−0.5 per inch measured along a diagonal in the as-knit tension. As shown in FIG. 2, each opening of the tricot knit mesh is defined by multiple loops of wire (loops 12) with at least one of the loops being formed by the same wire folded back upon itself, such that relative displacement between loops or wire at different portions of the mesh is permitted, thereby enabling the loops 12 at relatively different portions of the mesh to pass by one another and enter open regions of the mesh, so as to be effectively mechanically displaceable with respect to one another in the contour of the mesh in response to changes in environmental (thermal) conditions, whereby the effective contour of the antenna formed by the mesh is retained. Moreover this type of mesh has good mechanical properties both from a standpoint of manufacturability and handleability. The opening size of the mesh, i.e. spacing $S_o$ between loops 12, may lie within a range of two to seventy per inch. Because the mesh is tricot, having its inherent multiple twist loop properties, a tear or cut in the mesh does not propagate.

Figure 3:
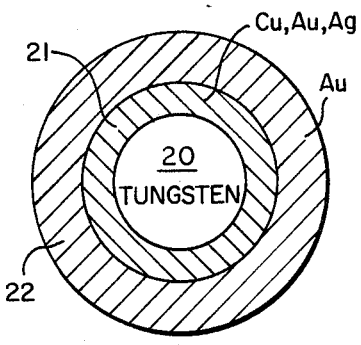
FIG. 3 is a cross-sectional view of an individual gold-plated tungsten wire fiber employed as an antenna mesh material in accordance with the present invention.

FIG. 3 shows a cross-sectional view of an individual gold-plated tungsten fiber of the antenna knit mesh material shown in FIGS. 1 and 2. Such a fiber is comprised of a tungsten center conductor 20 surrounded by a layer 22 of gold. The diameter of the tungsten center conductor 20 may be on the order of 0.4 to 1.5 mils, while gold cladding layer 22 may be formed to a thickness of 5μ inches to 100μ inches. In addition, an understrike layer 21, of up to 5μ inches thickness may be provided; the wider tube may be any one or any combination of gold, copper and silver.

As mentioned briefly above, gold-plated tungsten provides stable thermoelastic behavior properties, and with its small diameter and tricot knit configuration, provides significant load absorption and thermo-elastic deformation capabilities. Because it can be drawn to very fine diameter, tungsten can be used in a knit mesh such as the tricot mesh of FIG. 2, having low mechanical stiffness. Such a fine diameter may be reduced to 0.5 mils and still maintain sufficient tensile strength. The reason for low structural stiffness may be attributed to the fact that mechanical in-plane stiffness in a mesh has been shown to be dominated by wire diameter. Because tungsten is capable of being drawn to a diameter finer than molybdenum, the previous industry standard, a reduced stiffness results, so that a denser knit mesh can be made for use at RF frequencies higher than previously possible. In addition, the very low coefficient of thermal expansion ($2.2\times10^{6}$in/in F.°) assists in maintaining surface stability.

While we have shown and described several embodiments in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are obvious to one of ordinary skill in the art.

What is claimed:

1. An antenna for radio waves comprising a conductive open mesh formed of wire containing gold and tungsten, with each opening of said mesh being defined by multiple loops of wire, wherein at least one of said loops is formed by the same wire folded back upon itself, the mesh being configured such that relative displacement between loops of wire at different portions of the mesh is permitted, thereby enabling the loops of wire of said mesh at relatively different portions of the mesh to pass by one another and enter open regions of the mesh, so as to be effectively mechanically displaceable with respect to one another in the contour of the mesh in response to changes in environmental conditions, whereby the effective contour of the antenna formed by the mesh is retained.

2. An antenna according to claim 1, wherein said wire comprises a center wire of tungsten surrounded by a layer of gold.

3. An antenna according to claim 1, wherein said wire is comprised of respective layers of gold and tungsten.

4. An antenna according to claim 1, wherein said wire comprises gold-plated tungsten wire.

5. An antenna according to claim 4, wherein the diameter of said tungsten wire lies in a range from 0.4 to 1.5 mils.

6. An antenna according to claim 5, wherein the thickness of gold plated on said tungsten wire lies in a range of from 5 to 100 micro-inches.

7. An antenna according to claim 3, wherein said wire further includes an understrike layer of at least one metal selected from the group consisting of copper, gold and silver intermediate said layers of gold and tungsten.

8. An antenna according to claim 4, wherein said mesh is formed as a knit mesh having multiple twist loops such that a tear or cut in the mesh does not propagate.

9. An antenna for radio waves comprising wire having a center wire of tungsten surrounded by a layer of gold formed as open knit mesh, with each opening of said mesh being defined by multiple loops of wire, defined by multiple loops of wire, wherein at least one of said loops is formed by the same wire folded back upon itself, the mesh being configured such that relative displacement between loops of wire at different portions of the mesh is permitted, thereby enabling the loops of wire of said mesh at relatively different portions of the mesh to pass by one another and enter open regions of the mesh, so as to be effectively mechanically displaceable with respect to one another in the contour of the mesh in response to changes in environmental conditions, whereby the effective contour of the antenna formed by the mesh is retained.

10. An antenna according to claim 9, wherein said wire further includes an understrike layer of at least one metal selected from the group consisting of copper, gold and silver intermediate said tungsten wire and said layer of gold.

11. An antenna according to claim 9, wherein the diameter of said tungsten wire lies in a range from 0.4 to 1.5 mils.

12. An antenna according to claim 11, wherein the thickness of gold plated on said tungsten wire lies in a range from 5 to 100 micro-inches.

13. An antenna according to claim 9, wherein said mesh is formed as a knit mesh having multiple twist loops such that a tear or cut in the mesh does not propagate.

* * * * *